United States Patent [19]

Gentry et al.

[11] Patent Number: 4,843,696

[45] Date of Patent: Jul. 4, 1989

[54] METHOD AND APPARATUS FOR FORMING A STRANDED CONDUCTOR

[75] Inventors: Bobby C. Gentry, Carroll County; Bobby G. Workman, Heard County; Wilber F. Powers, Jr., Coweta County; Gary W. Bradley, Carroll County, all of Ga.

[73] Assignee: Southwire Company, Carrollton, Ga.

[21] Appl. No.: 48,177

[22] Filed: May 11, 1987

[51] Int. Cl.[4] ..... B21B 15/00

[52] U.S. Cl. ..... 29/33 F; 72/206; 72/224; 57/215

[58] Field of Search ..... 57/215; 174/36; 72/224, 72/206; 29/868, 33 F

[56] References Cited

U.S. PATENT DOCUMENTS

| | | | |
|---|---|---|---|
| 91,417 | 6/1969 | Cary | 29/745 X |
| 2,978,860 | 4/1961 | Campbell | 57/215 |
| 3,083,817 | 4/1963 | Campbell | 57/215 X |
| 3,143,786 | 8/1964 | Jones et al. | 72/206 |
| 3,164,670 | 1/1965 | Ege | 57/215 X |
| 3,320,788 | 5/1967 | Meier | 72/224 |
| 3,375,692 | 4/1968 | Ware | 72/206 |
| 3,417,593 | 12/1968 | Lewis | 72/211 |
| 4,311,001 | 1/1982 | Glushko et al. | 57/215 |
| 4,473,716 | 9/1984 | Jesseman | 29/745 X |

FOREIGN PATENT DOCUMENTS

| | | | |
|---|---|---|---|
| 2137907 | 10/1984 | United Kingdom | 174/36 |

*Primary Examiner*—Carl J. Arbes

*Attorney, Agent, or Firm*—Stanley L. Tate; James W. Wallis, Jr.

[57] ABSTRACT

A method and apparatus for the high speed reshaping of round wire as it exits a drawing machine, but prior to its being collected on a bobbin or a stempack. The shape imparted to individual wires is such that as the pre-shaped wires are applied to a core by a stranding machine, a cable results in which there is substantially no interstitial space between the wires which add excessive bulk.

14 Claims, 3 Drawing Sheets

METHOD AND APPARATUS FOR FORMING A STRANDED CONDUCTOR

TECHNICAL FIELD

This invention relates to an improved method and apparatus for forming a compact stranded conductor. More particularly, it relates to an improved method and apparatus for preshaping a wire conductor strand and then forming a stranded conductor cable using such preshaped wires.

BACKGROUND ART

Electrical conductors are customarily fabricated by stranding together a plurality of wires in concentric layers. The natural geometry of such a construction is that when round wires of the same diameter are used to form a stranded conductor, six wires fit around a single core wire, twelve wires fit around the layer of six wires, eighteen wires fit around the layer of twelve wires and so on with each successive layer containing six wires more than are contained in the layer around which they are being stranded. Conductors of this configuration are known as concentric lay conductors. The number of individual wires contained in any conductor having "n" layers of wire and being so constructed is calculated by the algebraic equation $X=3n^2+3n+1$ where X represents the number of wires forming the conductor and n represents the number of layers being stranded about the central wire. Concentric lay conductors have the disadvantage of being relatively large in diameter for a given cross section of conducting metal. This is due to the open spaces or interstices between the wires. This interstitial space adds only to the bulk of the conductor and does not contribute to its conductivity.

Reduction of the diameter of a concentric lay conductor is practiced through a process known as compacting. Such a process is taught in U.S. Pat. No. 1,943,087. In this process, the stranded conductor is radially crushed and metal from the round wires is forced to flow into the interstices. The result is a conductor having a smaller diameter than an equivalent concentric lay conductor.

The aforementioned patent taught the art of compacting stranded conductors by means of pressure rolls. More recently, U.S. Pat. No. 3,760,093 teaches that it is also feasible to effect the compacting by pulling the conductor through a wire drawing type die between the application of each layer of wires as the conductor is being stranded.

Compacting such a stranded conductor, however, changes the geometric dimensional relationships so that a layer having six more wires than the underlying layer no longer fits naturally onto the conductor. The aforementioned compact conductor patent teaches, and the teaching is generally followed in commerce, that, to compensate for the reduction in diameter of the conductor core by compacting, the individual diameters of wires used in succeeding layers of the conductor should be reduced.

Significant disadvantages exist in conductors formed either by rolling the ,stranded, conductor, as taught in U.S. Pat. No. 1,943,082; or by drawing the conductor through a drawing type die between the application of each successive layer of wires, as taught in U.S. Pat. No. 3,760,093. One disadvantage is that the individual wires are characterized by wide variations of their physical properties. This is due to uneven work hardening of the wires as a result of each wire's position within the stranded structure. Wires located closer to the center of the conductor receive a greater amount of work hardening than those strands near the surface. This increased amount of work hardening results in higher unit tensile strengths, higher hardness numbers, and lower elongations. Another disadvantage of these methods of compacting a stranded conductor is that as the conductor is compacted, the individual wires impress substantial indentations into each other at every point where one wire crosses another one. This is a natural result of compressing and plastically deforming the individual wires where they cross each other in their opposing lay. Such an indentation reduces the cross section of the conductor and creates a weak point which is more succeptable to failure. When such conductors are exposed to the tensions and compressions normally encountered in their intended use, they fail earlier than they would had they been constructed of wires having uniform physical properties and no indentions.

The use of stranded conductors constructed of individual wires with some wires shaped to eliminate a certain amount of interstitial spacing is also known. Several methods and devices for producing such conductors, and various conductors or cables so produced, are found in U.S. Pat. Nos. 3,383,704; 3,444,684; 4,175,212; 4,436,954; 4,048,794; 2,978,860; 3,083,817; 3,130,536; 3,164,670; and 3,234,722.

U.S. Pat. Nos. 3,383,704 and 3,444,684 teach a method and apparatus for forming a multistrand conductor having a core of substantially circular cross section and a plurality of layer wires, each of which is of substantially circular cross section and each of which has a slightly flattened region along its length. This flat region is limited in width to that width which can be achieved by deforming the individual wire strands without causing the conductor to have the above discussed undesirable characteristics.

U.S. Pat. No. 4,175,212 teaches a conductor constructed so as to minimize a change in the length of the conductor as it is put under load and its temperature increases. The conductor is described as having a modified trapezoidal shaped wire strand composition, but the method of forming these strands and the advantages of using such a construction is limited to a description of a method of fabricating the stranded conductor lay such that expansion of tee individual wire strands does not detrimentally affect the length of the multiple strand conductor.

U.S. Pat. No. 4,436,954 teaches a steel-cored aluminum conductor used mainly for electric power conduction. The steel core of the conductor is a stranded cable. An aluminum mantle surrounding the core consists generally of cable-like staples. The advantages of the product of this patent rests in its use of an intermediate layer of material between the steel core and the aluminum wires or staples stranded thereon. This intermediate layer minimizes the effect of the interaction, both chemically and mechanically, of the dissimilar metals used to form the conductor. Though the outer aluminum wires are described as being trapezoidally shaped, they are roughly formed by the action of a drawing stone, which the conductor is drawn through between the application of each layer of the conductor.

As described above, forming a compacted conductor is taught in U.S. Pat. No. 3,760,093. In this process, the stranded conductor is drawn through a compacting die between the application of each layer of wires as they are stranded onto the conductor. The result is that as each layer is deformed, metal from the individual round wires flows into the interstices and a more compact conductor results. The disadvantages of this process are the lack of uniformity of the physical properties of the individual wires and the weak spots created by the resulting indentions in the wire strands.

U.S. Pat. No. 4,048,794 teaches the use of layers of shaped conductors in submarine anchorage cables. In this process, layers of wire having a Z-shaped cross section are utilized in the outer layers of a stranded cable. These wires are positioned such that the Z-shaped cross sections interlock. The purpose of such a configuration is to produce a layer or layers of interlocking wires that effectively seal the cable and prevent the introduction of sea water into the inner portions of said cable. No claim is made nor is the construction of such a cable intended to reduce the diameter of the cable.

U.S. Pat. No. 3,164,670 also teaches the use of swaging or crushing a layered cable to reduce the interstitial spacing. This patent teaches that from a practical point of view there is a limit to the size of the conductor that can be satisfactorily compacted using either a roll swaging or a drawing die type compacting operation. This patent teaches the compacting of the inner or core portions of the conductor followed by an application of preformed trapezoidal conductors, which it calls keystone shaped wires, stranded about the core. These trapezoidal shaped conductors are coated with insulating enamel. An alternative to the insulating enamel is the use of insulating polyester film tapes. The inventors purpose is stated as designing a conductor, as described above, so that the required degree of flexibility and minimum diameter of the cable cross section can be obtained without sacrificing dimensional accuracy. The method of constructing the cable herein is similar to methods referenced above in that the core is compacted after it is stranded to minimize the interstitial spacing. After the central layers have been compacted, trapezoidal shaped wires are applied to the outside of the cable. Again, the disadvantages of a cable so compacted are present in the core.

U.S. Pat. Nos. 3,083,817 and 2,978,860 deal with the manufacture of wire ropes. In these patents, a layer of wires smaller in diameter than the central or core wire are applied directly to the core wire, then a layer of wires having a diameter equal to the diameter of the core wire is stranded on top of the smaller wires. These conductors are then passed through a suitable drawing die and a compact product is obtained. The difference between the method taught herein and those methods described above is that the interstitial spacing is filled with the wires having a smaller diameter, and does not require the larger diameter wires to flow into the interstitial spaces. One teaching of this patent is a core or king wire, nine smaller wires surrounding it, and six wires of the same diameter as the core or king wire surrounding the ten. When the cable so conformed is passed through a drawing die, the natural result is the core or king wire acquiring a six sided configuration, and the nine smaller wires and the six wires having the same diameter as the king wire acquiring a five sided configuration. This construction is taught to make a steel wire rope that will have the five sided or keystone configuration wires around its outer layer. The advantages to this construction are mainly in the uniformity of its cross section and the lack of any tendency of these flat multi-sided wires to want to roll between the layers of wires which constitute the rope.

U.S. Pat. No. 3,130,536 also teaches the construction of wire rope. As above, the wire rope is constructed by utilizing wires of smaller diameter to fill the interstitial spacing such that when the cable is subjected to a compressing or a compacting operation less deformation of the larger wires is required and the interstitial spacing is filled with the swaged smaller diameter wires.

U.S. Pat. No. 3,234,722 teaches another method of cable fabrication. This patent teaches compacting six wires which surround a central core wire, then the application of alternating large and small wires in the next layer. When this layer is compacted the result is a conductor with an outer layer which more nearly properly fits over the seven strand core. The advantage stated in this patent is that upon compacting this outer layer of alternating size conductors there is a minimum amount of nicking and sharp edges protruding from this layer of wire since it now is a better geometrical fit than would be the case if twelve wires of a larger diameter were used instead of the six large and six smaller wires.

It should be readily seen that stranded conductors formed of shaped wires is not unknown in the industry. It should be evident from a reading of the above references that compacted electrical conductors are used and accepted in the industry and are desirable. It should also be evident from a reading of the above references that there are disadvantages associated with forming compacted conductors by the methods described.

Attempts have been made to overcome problems associated with compacting stranded conductors. One solution to the problems is to preform the wires into a shape that more efficiently utilizes the space they occupy in the stranded conductor prior to the stranding or assembly of the conductor. A trapezoidally shaped wire substantially fills the interstitial spaces and results in a more compact conductor. Typically, such a wire is formed during the drawing operation by drawing a round wire through a die having the trapezoidal shape. One disadvantage of this method is the tremendous decrease in speeds at which round wires can be drawn through such dies, when compared to speeds at which round wires are normally drawn. Another disadvantage is the expense of producing drawing dies having a trapezoidal geometry.

Reforming or reshaping a wire after it has been drawn but before it is collected at the end of the drawing machine eliminates many of the disadvantages described above. By utilizing a separate forming means, the speed at which a round wire can be reshaped is no longer a function of how fast such a wire can be drawn through an irregularly shaped hole in a drawing die, but rather how fast the forming means can accomplish its task.

One such forming means for reforming a round wire into one having a desired cross section comprises a first and second wheel, the wheels being singly, individually and rotatably mounted respectively on a first and second axle, the axis of said first axle being parallel to the axis of said second axle, and the axis of both axles positioned at right angles to the axis of movement of said round wire, and each wheel having a groove machined into its periphery, said groove forming a portion of the reshaped cross sectional configuration desired of said reshaped wire, and the periphery of said first wheel being tangent to the periphery of said second wheel at a point, said point being substantially aligned with the axis of movement of said reshaped wire.

DISCLOSURE OF THE INVENTION

Accordingly it is an object of the present invention to provide a method and an apparatus by which round wires may be reformed and collected and then fabricated into a stranded conductor.

Still another object of the present invention is to provide a method and apparatus to increase the speed at which a round wire may be reshaped.

Yet another object of the present invention is to provide a method and an apparatus by which a stranded conductor, having layer(s) of trapezoidally shaped wires, may be fabricated at speeds substantially equivalent to those speeds at which concentric lay conductors are fabricated.

Even another object of the present invention is to provide a method and apparatus for producing a compact stranded conductor utilizing a single diameter round wire to form the shaped strands in each of its plurality of layers.

And another object of the present invention is to provide a method and apparatus to produce a stranded conductor comprising individual wires having substantially uniform and desirable physical properties and said conductor having a reduced diameter as compared to an equivalent concentric lay conductor.

A feature of the present invention is the provision of a reshaping apparatus that will allow a round wire to be reshaped as it exits the end of a drawing machine but before the reshaped wire is collected.

Another feature of the present invention is the provision of a method by which a stranded conductor may be formed from shaped wires, at speeds substantially equal to the speed the same strander could operate if it were forming a stranded conductor using round wires.

And another feature of the present invention is the provision of individually shaped wires having the proper geometry to allow them to be fabricated into a stranded conductor that will have substantially less interstitial space present between said wires than is present between round wires in a concentric lay conductor.

Even another feature of the present invention is the provision of a method and apparatus by which round conductors can be reshaped without detrimentally changing their physical properties.

Still another feature of the present invention is the provision of a method and apparatus that will allow a round wire of a single size to be utilized in forming each of the different shapes required for various layers of wires forming a compact stranded conductor.

And still another feature of the present invention is the ability to form round wires such that a plurality of cable designs may be obtained by varying the shape and number of wires utilized in various layers of the stranded conductor.

And a feature of the present invention is a trim adjustable housing to adjust the separation of the wheels of the forming means.

Even another feature of the present invention is that the guide of the forming means is also a seal to keep drawing lubricant contained within the drawing machine.

An advantage of the present invention is the production of a stranded conductor, utilizing shaped wires, at machine speeds which are substantially similar to those speeds normally attained while fabricating a concentric lay conductor utilizing round wires.

Another advantage of the present invention is the uniformity of physical properties that are maintained in the individual reshaped wires.

Another advantage of the present invention is that it can be used to form and strand any number of different metal wire conductor compositions.

Still another advantage of the present invention is the ability to fabricate a cable having a smaller diameter, compared to a concentric lay conductor, for a given conductivity requirement.

Yet even another advantage of the present invention is the small expense involved in manufacturing the reshaping means.

Still even another advantage of the present invention is the speed at which the round wires may be reshaped.

Yet still another advantage of the present invention is the improved surface quality of the stranded conductor so constructed when compared to a concentric lay conductor that has been compacted.

Even another advantage is the reduction of insulating plastic that is required to insulate an equivalent compact conductor because of its smaller cross section.

An advantage is that the wire may be collected with no further processing if a wire having a highly worked structure is desired.

Another advantage is that after forming, as described above, the wire can be processed through an inline annealing process, prior to collecting it, if a wire with an annealed property is required.

Still another advantage of the process is that speeds equal to those of the drawing machine can be maintained by such a reforming means, which results in no loss of production rates while producing a wire having a trapezoidal cross section.

Even another advantage of the invention is the elimination of the undesirable properties obtained when a standard concentric lay conductor is compacted.

A further advantage is that excessive work hardening is eliminated during conductor stranding or fabrication since the conductor need not be swaged or crushed.

Yet another advantage is that the reformed wire cross sections naturally fill interstitial spaces.

And even another advantage of the invention is the elimination of indentions created in the wires, at the points where they cross each other, when the concentric lay conductor is compacted.

A further advantage of the present invention is the ability to form any number of different wire shapes from a round wire.

In accordance with these and other objects, features and advantages of the present invention, there is provided a method of and an apparatus for the continuous reshaping of a round wire conductor, said reshaping being accomplished at high rates of speed, said wires then being used to form a stranded conductor.

Also in accordance with the present invention, there is provided an apparatus comprising a plurality of wheels, said wheels having grooves machined into their peripheries, such that various shapes may be imparted to round wires.

In accordance with the present invention, there is provided a trim adjustment for varying the cross sectional area of a wire as it is reformed.

Also in accordance with the present invention, there is provided a method and apparatus for controlling the physical properties of a wire being reformed from a substantially round feed stock.

And in accordance with the present invention, there is provided a method of stranding reformed wires into a compact conductor.

Also in accordance with the present invention, there is a product from the process described herein.

Although the present invention has been discussed and described with primary emphasis on one preferred embodiment, it should be obvious that adaptations and modifications can be made thereto without departing from the spirit and scope of this invention.

BEST MODE FOR CARRYING OUT THE INVENTION

Figure 1:
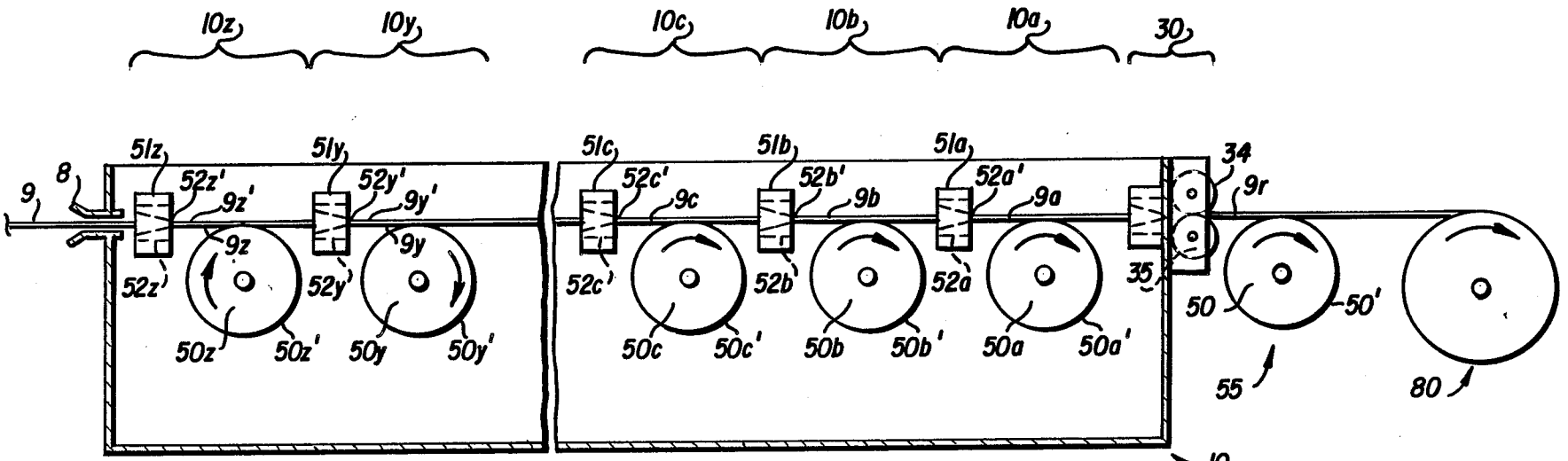
FIG. 1 is a cross sectional view of the present invention illustrating the relative positioning of its major components.

Refer now to FIG. 1, which is a cross sectional view of the present invention illustrating the relative positioning of the major functional components which comprises: drawing machine 10, forming means 30, pulling means 55, and collecting means 80. The components which most directly operate upon moving drawing stock 9 as it passes through drawing machine 10 are a series of similar drawing stations, e.g. 10*a*, each of which comprises a capstan, a die holder, and a drawing die. The major components of typical drawing station 10*a* comprise: capstan 50*a*, die holder 51*a*, and drawing die 52*a*. Each drawing station is similar to each other drawing station, with the rotational speed of its capstan being the primary difference between individual drawing stations.

Drawing stock 9 enters drawing machine 10 through entry guide 8 of drawing machine 10 which substantially aligns stock 9 with first drawing die 52*z*. It should be stated that the number of dies is variable and will be determined by the design of the individual drawing machine 10. The number of "capstan / die-holder / die" stations utilized by a specific drawing machine will be a function of its design. The leading end of drawing stock 9 is mechanically reduced in diameter and passed through drawing die 52*z*, drawing die 52*z* being a die having a drawing diameter less than the diameter of drawing stock 9, which is positioned by die-holder 51*z*. The leading end of drawing stock 9 is wrapped around capstan 50*z* in a clockwise direction, clockwise being the direction of rotation of capstan 50*z*. As capstan 50*z* rotates in a clockwise direction, frictional forces between surface 50*z*′ of capstan 50*z* and the surface 9*z*′ of stock 9*z* result in stock 9 being pulled through drawing die 52*z*. Since hole 52*z*′ in die 52*z* is smaller than the diameter of drawing stock 9, drawing stock 9 is elongated as it is pulled through said hole and now has substantially the same diameter as hole 52*z*′ through which it is pulled. Drawing stock 9 is now identified as drawing stock 9*z*.

The leading end of stock 9*z* is mechanically reduced and passed through drawing die 52*y*. The leading end of now drawing stock 9*z* is wrapped around capstan 50*y* in a clockwise direction, clockwise being the direction of rotation of capstan 50*y*. As capstan 50*y* rotates in a clockwise direction, frictional forces between surface 50*y*′ and the surface 9*y*′ of stock 9*y* result in stock 9*z* being pulled through drawing die 52*y*. Since hole 52*y*′ in die 52*y* is smaller than the diameter of drawing stock 9*z*, drawing stock 9*z* is elongated as it is pulled through said hole and now has substantially the same diameter as hole 52*y*′ through which it was pulled.

The above process is repeated at each drawing station of drawing machine 10. Original drawing stock 9 is reduced in diameter in each drawing station through which it passes, and with each reduction in diameter, said drawing stock becomes longer. As said drawing stock is pulled through die 52*a*, which is the last drawing die through which said stock passes, it takes substantially the same diameter as hole 52*a*′ through which it was pulled.

Figure 2:
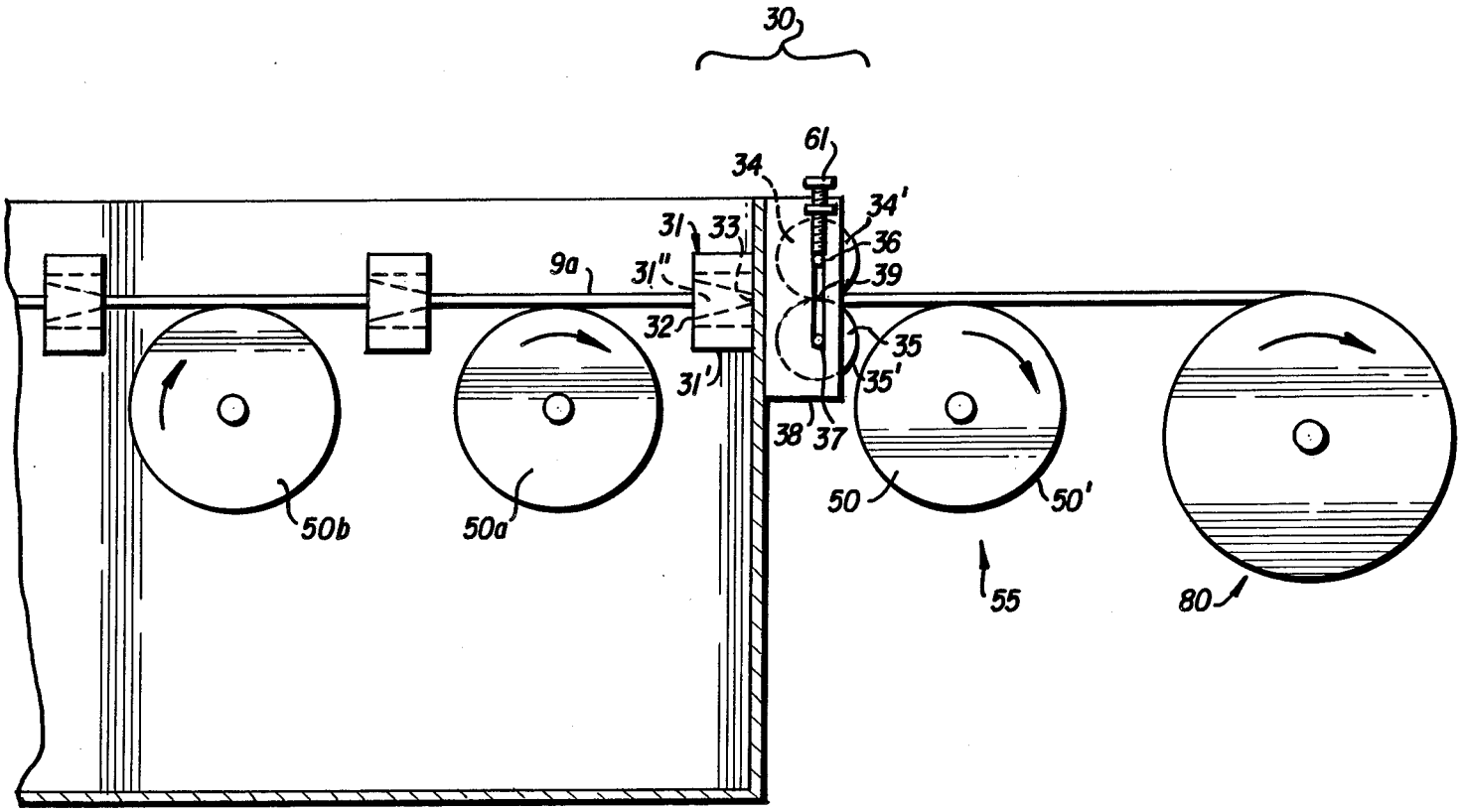
FIG. 2 is a cross sectional view of the forming means illustrating the relative positioning of its major components.

Refer now to FIG. 2, which is an illustration of the major components of forming means 30 and their relative positions. Forming means 30 comprises: guide means 31, first wheel 34, first axle 36, second wheel 35, second axle 37, housing 38, and trim adjustment 60 (see FIG. 2*a*, 2*b*, and 2*c*).

After round wire 9*a* leaves capstan 50*a*, it is directed by guide means 31, said guide means 31 comprising: cylindrical body 31′ and tapered axial bore 31″, said bore having a first or entry end 32 and a second or exit end 33. Axial bore 31″ of guide means 31 is substantially axially aligned with axis of movement of round wire 9*a*, said axis of movement of round wire 9*a* being substantially, aligned with tangent point 39 (also see FIG. 2(*b*) 34 and second wheel 35 as illustrated.

The leading end of round wire 9*a* is pulled through forming means 30 comprising: groove 40 machined into said first wheel 34 and groove 40′ machined into said second wheel 35. The reformed wire 9*r* from round wire 9*a*, having been pulled through forming means 30, is wrapped around capstan 50 in a clockwise direction, clockwise being the direction of rotation of capstan 50. As capstan 50 rotates in a clockwise direction, frictional forces between surface 50′ of capstan 50 and the surface 9*r*′ of reformed wire 9*r* results in round wire 9*a* being pulled through grooves 40 and 40′ respectively machined into the peripheries of said first wheel 34 and said second wheel 35, and there being reformed into reformed wire 9*r*.

First wheel 34 is rotatably mounted on first axle 36 and second wheel 35 is rotatably mounted on second axle 37. First axle 36 and second axle 37 are positioned within housing 38 such that the axis of said first axle 36 and the axis of said second axle 37 are parallel to each other and are perpendicular to the axis of movement of wire 9*a* as it is traveling. Periphery 34′ of wheel 34 and periphery 35′ of wheel 35 are tangent at a point 39, said point 39 being substantially aligned with the axis of movement of wire 9*a*.

The shape 90 of wire 9*r* is defined by grooves 40 and 40′ respectively machined into periphery 34′ of wheel 34 and periphery 35′ of wheel 35. The cross sectional view of groove 40 when joined with the cross sectional view of groove 40' produce the configuration 90 of reformed wire 9r.

In the present invention, the cross sectional area of round wire 9a is reduced to its final size and shape as it is passed through forming means 30 and results in reformed wire 9r.

After reformed wire 9r exits capstan 50, it is collected on collecting means 80. A typical collecting means 80 is a bobbin assembly.

Figure 2C:
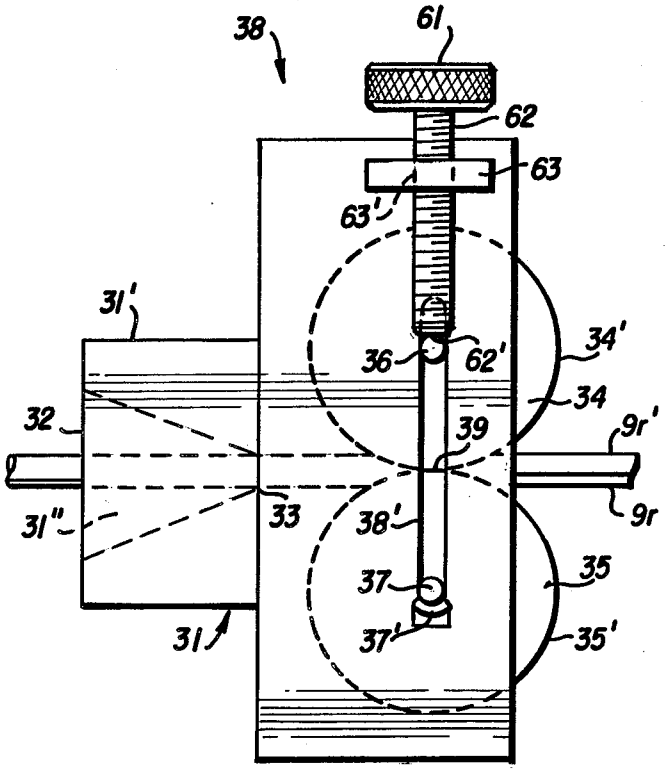
FIG. 2*c* is a cross sectional view of the forming means illustrating the relative positioning of its major components.
Figure 2B:
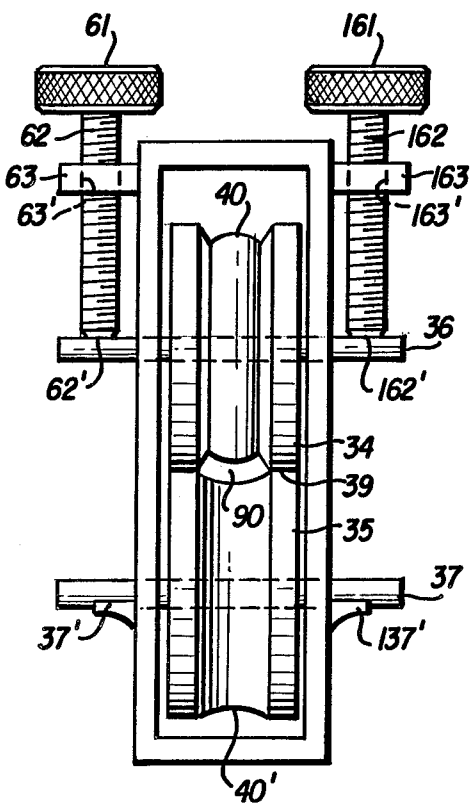
FIG. 2*b* is a front view of the configuration of the forming means and its major components.
Figure 2A:
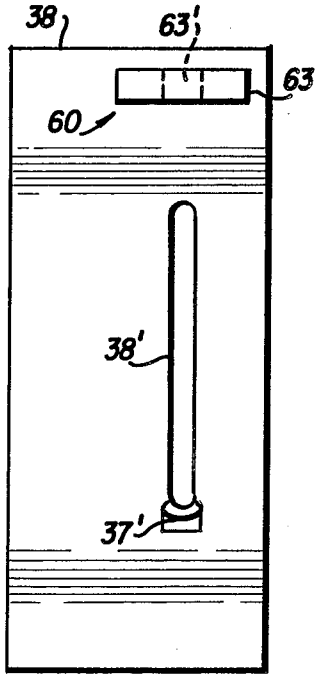
FIG. 2*a* is a representative view of one side of the frame of the reforming apparatus.

Refer now to FIG. 2a, which is an illustration of the first side of housing 38 of forming means 30. Housing 38 comprises a top and a bottom and a first and second side. In said first side of frame 38 is cut a vertical slot 38'. The width of slot 38' is controlled by diameter of axles 36 and 37 which travel vertically within said slot. Fixed to said first side of frame 38 is cradle 37' which supports second axle 37. Fixed nut 63 is attached to said first side of frame 38 directly above slot 38' and is positioned such that threaded hole 63' of fixed nut 63 is substantially axially aligned with slot 38'.

Refer now to FIG. 2b, which is an illustration of the major components of trim adjustment 60 viewed from the front or exit end of forming means 30. The left side of FIG. 2b represents said first side as described in FIG. 2a. It should be noted that the right side of FIG. 2b is substantially identical to the left side except being a mirror image. Second wheel 35 is held within frame 38 by axle 37 on which said wheel is mounted said axle extending through first and second side of frame 38 through slots 38' and 138' (not shown). Axle 37 nests within fixed cradle 37', said cradle being attached to said first side of frame 38, and fixed cradle 137', said cradle being attached to said second side of frame 38. Wheel 35 moves vertically within frame 38 as axle 37 moves vertically within slot 38' of said first side and slot 138' of said second side. First wheel 34 is secured within frame 38 in a like manner by first axle 36, said axle passing through frame 38 by means of slots 38' and 138' as described above. First wheel 34 also has vertical movement as axle 36 moves within slots 38' and 138'. Second wheel 35 has limited downward movement, being limited as axle 37 rests within fixed cradles 37' and 137'. The downward movement of first wheel 34 is restricted by second wheel 35. When said wheels contact each other at tangent point 39, downward movement of first wheel 34 ceases. The shape 90 imparted to round wire 9a is defined by the combination of groove 40 in first wheel 34 and groove 40' in second wheel 35. As round wire 9a is pulled through forming means 30, the natural tendency is for wheel 34 and wheel 35 to separate. Cradles 37' and 137' prevent second wheel 35 from moving downward. Vertical movement of first wheel 34 is prevented by a first and second trim adjustment 60 and 160, respectively, located on first and second sides of frame 38. Screws 62 and 162 pass through threaded holes 63' and 163', respectively, and contact axle 36 at points 62' and 162'. The upward travel of first wheel 34 is restricted by the action of screws 62 and 162 which prevent axle 36 from moving vertically within slots 38' and 138'. Screws 62 and 162 are adjusted by screw adjustment knobs 61 and 161, respectively, such that as round wire 9a passes through forming means 30, wheel 34 is restricted in its upward movement by the preset positions of said screws 62 and 162. Upward movement of wheel 34 is precalculated and preset by screws 62 and 162 such that when wheel 34 is at its maximum permissable vertical movement, proper dimensions for shape 90 are obtained.

Refer now to FIG. 2c, which is an illustration of forming means 30 as viewed from first side of frame 38. Round wire 9a enters guide means 31 add is guided between first wheel 34 and second wheel 35. As round wire 9a passes between said first and second wheels, first wheel 34 moves upwardly until axle 36 contacts the end of screw 62 at point 62'. As wire 9a passes through forming means 30 it is reshaped and is now identified as wire 9r. Corresponding contact of screw 162 at point 162' on axle 36 is also made on second side of frame 38.

Figure 3:
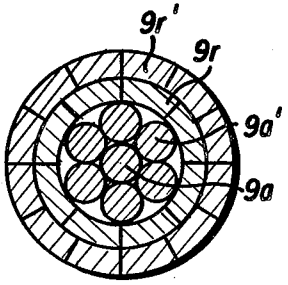
FIG. 3 is a transverse view of the configuration of the wires as they are positioned in the stranded conductor.

Refer now to FIG. 3, which is an illustration of a typical compact product. Core wire 9a is surrounded by 6 strands of wire 9a', core wire 9a and strand wire 9a' being substantially the same diameter. Surrounding these seven wires are formed wires 9r and 9r'. Wires 9r and 9r' are shaped so that they have substantially less interstitial space than an equivalent concentric lay conductor.

Figure 4:
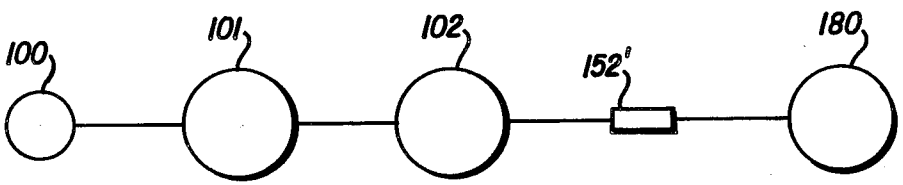
FIG. 4 is a cross sectional view of a stranding means for producing a stranded conductor.

Refer now to FIG. 4, which is a block diagram of a typical conductor stranding system. Source 100 feeds a core wire (not shown) on which is stranded six substantially similar wires (not shown) supplied by source 101. This stranded core (not shown) is then advanced and a plurality of shaped wires (not shown), supplied by source 102, is appllied about said core. The conductor so formed (not shown) is then passed through drawing die 152' where the diameter of said conductor is reduced 1%, said reduction imparting a set to the individual wires such that they substantially loose their tendency to spring apart and tend to maintain a desired compact configuration. Said cable (not shown) is then collected on collecting means 180, said means typically being a reel assembly.

What is claimed is:

1. Passing an electrical wire through a reshaping means for reshaping a round electrical wire after said round wire has been drawn down in a drawing machine from larger diameter stock, but before said wire has been collected at the end of a drawing machine, comprising:

guiding said conductor, with a guide means for guiding, after it exits said drawing machine, into a reshaping means, said reshaping means comprising a pair of opposed reforming means and being juxtaposed between said drawing machine and a pulling means;

reshaping said conductor in said reshaping means, said reshaping means being juxtaposed between said drawing machine and a pulling means;

pulling said conductor through said reshaping means, said pulling means positioned between said reshaping means and a collecting means; and collecting said conductor after it has been reshaped, said collecting means being positioned after said pulling means.

2. The method of claim 1 wherein the reforming means is a first and second wheel, said wheels being singly, individually, and rotatably mounted respectively on a first and second axle, the axis of said first axle being parallel to the axis of said second axle, and the axis of both axles positioned at right angles to the axis of movement of said round wire, and each wheel having a groove machined into its periphery, said groove forming a portion of the reshaped cross sectional configuration of said reshaped wire, and the periphery of each wheel being tangent to the periphery of the other wheel at a point, said point being substantially aligned with the axis of movement of said electrical wire, and the cross sectional area of said reshaped wire being controlled by a trim adjustment.

3. The method of claim 1 wherein the guide means comprises a cylindrical body, said cylindrical body having a conical channel having an entrance end and an exit end, said entrance end being larger than said exit end and said exit end substantially aligned with said reshaping means.

4. The method of claim 2 wherein said first and second wheels are positioned such that a plane passed through the tangent point of said first and second wheels, and said plane being perpendicular to the axis of moving conductor, the intersection of said plane with the surfaces of said grooves in said wheels projects a trapezoidal configuration.

5. The method of claim 4 wherein said trapezoidal configuration is modified such that the side that was the shorter parallel face of said trapezoid is now concave, and the side that was the longer parallel face of said trapezoid is now convex.

6. The method of claim 5 wherein said modified trapezoidal shape geometrically fits substantially precisely with other such modified shapes when positioned about a core and said positions produce a configuration having substantially no interstitial spacing.

7. The method claim 5 wherein the geometry of each trapezoidal shape, as modified, is properly dimensioned for a specific layer of a plurality of layers stranded about a core.

8. The method of claim 7 including the step of stranding a plurality of said reshaped electrical wires about a core.

9. Apparatus for reshaping a round electrical wire after said round wire has been drawn down in a drawing machine from larger diameter stock, but before said wire has been collected at the end of a drawing machine, comprising:

a reshaping means for reshaping said conductor, said reshaping means comprising a first and second wheel, said wheels being singly, individually, and rotatably mounted respectively on a first and second axle, the axis of said first axle being parallel to the axis of said second axle, and the axis of both axles positioned at right angles to the axis of movement of said round wire, and each wheel having a groove machined into its periphery, said groove forming a portion of the reshaped cross sectional configuration of said reshaped wire, and the periphery of each wheel being tangent to the periphery of the other wheel at a point, said point being substantially aligned with the axis of movement of said electrical wire, and the cross sectional area of said reshaped wire being controlled by a trim adjustment and being attached to said drawing machine and juxtaposed between said drawing machine and a collecting means;

a guide means positioned at the entry end of said reshaping means for guiding said round wire into said reshaping means after said round wire leaves the exit end of said drawing machine;

a pulling means positioned at the exit end of said reshaping means for pulling said wire through said reshaping means; and a collection means for collecting said wire after said wire has been reshaped, said means being positioned after said pulling means.

10. The apparatus of claim 9 wherein the guide means comprises a cylindrical body, said cylindrical body having a conical axial channel comprising an entrance end and an exit end, said entrance end being larger than said exit end and said exit end substantially axially aligned with said tangent point of the peripheries of said wheels.

11. The apparatus of claim 9 wherein said first and second wheels are positioned such that a plane passed through the tangent point of said first and second wheels, and said plane being perpendicular to the axis of moving conductor, the intersection of said plane with the surfaces of said grooves in said wheels projects a trapezoidal configuration.

12. The apparatus of claim 11 wherein said trapezoidal configuration is modified such that the side that was the shorter parallel face of said trapezoid is now concave, and the side that was the longer parallel face of said trapezoid is now convex.

13. The apparatus claim 12 wherein said modified trapezoidal shape geometrically fits substantially precisely with other such modified shapes when positioned about a core said positions produce a configuration having substantially no interstitial spacing.

14. The apparatus of claim 12 wherein the geometry of each trapezoidal shape, as modified, is properly dimensioned for a specific layer of a plurality of layers stranded about a core.

* * * * *